US008403246B2

(12) United States Patent
Seo et al.

(10) Patent No.: US 8,403,246 B2
(45) Date of Patent: Mar. 26, 2013

(54) SHREDDER AND METHOD OF SHREDDING PAPER

(75) Inventors: Hwa Yong Seo, Seoul (KR); Hak Hyun Kim, Pohang-si (KR); Dae Seung Woo, Seoul (KR)

(73) Assignee: Royal Sovereign International, Inc., Rockleigh, NJ (US)

( * ) Notice: Subject to any disclaimer, the term of this patent is extended or adjusted under 35 U.S.C. 154(b) by 236 days.

(21) Appl. No.: 12/839,977

(22) Filed: Jul. 20, 2010

(65) Prior Publication Data

US 2012/0018554 A1 Jan. 26, 2012

(51) Int. Cl.
*B02C 18/22* (2006.01)

(52) U.S. Cl. ..... 241/225

(58) Field of Classification Search ..... 241/36, 241/100, 236, 224, 225
See application file for complete search history.

(56) References Cited

U.S. PATENT DOCUMENTS

| | | | | |
|---|---|---|---|---|
| 4,650,128 | A * | 3/1987 | Goldhammer | 241/36 |
| 7,422,171 | B2 * | 9/2008 | Huang | 241/225 |
| 8,196,851 | B2 * | 6/2012 | Aries et al. | 241/225 |
| 2002/0070300 | A1 * | 6/2002 | McLean et al. | 241/30 |

* cited by examiner

*Primary Examiner* — Mark Rosenbaum
(74) *Attorney, Agent, or Firm* — Saliwanchik, Lloyd & Eisenschenk

(57) ABSTRACT

Provided is a paper shredder. The paper shredder includes a paper support part including a first paper support part having a first length, a second paper support part having a second length greater than the first length, and a paper feed slot between the first paper support part and the second paper support part, a first roller in which a portion thereof is exposed upward from the second paper support part through an opening defined in the second paper support part, a second roller in which a portion thereof is exposed upward from the first paper support part through an opening defined in the first paper support part, a cutter disposed below the paper feed slot to shred an introduced paper, and a motor operating the first roller, the second roller, and the cutter. The first paper support part and the second paper support part are reduced in height as being adjacent to the paper feed slot.

10 Claims, 11 Drawing Sheets

SHREDDER AND METHOD OF SHREDDING PAPER

TECHNICAL FIELD

The present disclosure relates to a paper shredder and a method of shredding papers.

BACKGROUND ART

Paper shredders are devices that safely and quickly shred unnecessary or secret documents to remove the documents.

Paper shredders can shred papers by manually feeding the papers or a large amount of paper by automatically feeding the large amount of paper using an automatic paper feeding system. In particular, in case where the large amount of paper is automatically fed using the automatic paper feeding system to shred the papers, the troubles of the paper shredder such as paper jam, paper overfeeding, and paper feeding interruption may occur due to wrinkle or rip in paper.

Generally, unlike papers fed into devices such as copying machines, papers fed into paper shredders may be very damaged due to use for a long time. As a result, the automatic paper feeding system may not be smoothly operated.

DISCLOSURE OF THE INVENTION

Technical Problem

Embodiments provide a paper shredder having a new structure and a method of shredding a paper.

Embodiments also provide a paper shredder that reduces troubles generated in an automatic paper feeding system such as paper jam, paper overfeeding, and paper feeding interruption and a method of shredding a paper.

Embodiments also provide a paper shredder that further quickly shreds a paper and a method of shredding a paper.

Technical Solution

In one embodiment, a paper shredder includes: a paper support part including a first paper support part having a first length, a second paper support part having a second length greater than the first length, and a paper feed slot between the first paper support part and the second paper support part; a first roller in which a portion thereof is exposed upward from the second paper support part through an opening defined in the second paper support part; a second roller in which a portion thereof is exposed upward from the first paper support part through an opening defined in the first paper support part; a cutter disposed below the paper feed slot to shred an introduced paper; and a motor operating the first roller, the second roller, and the cutter, wherein the first paper support part and the second paper support part are reduced in height as being adjacent to the paper feed slot.

In another embodiment, a paper shredder includes: a paper support part including a first paper support part, a second paper support part, and a paper feed slot between the first paper support part and the second paper support part; at least one or more rollers respectively disposed on the first paper support part and the second paper support part; a cutter disposed below the paper feed slot to shred an introduced paper; and a motor operating the rollers and the cutter, wherein the number of rollers disposed on the first paper support part and the number of rollers disposed on the second paper support part are different from each other.

In a further embodiment, a method of shredding a paper shredder includes: shredding a first group paper by a cutter disposed below a paper feed slot while the first group paper moves into the paper feed slot by a second roller disposed on a first paper support part and first and third rollers disposed on a second paper support part with the paper feed slot therebetween; and moving a second group paper disposed on the first group paper into the paper feed slot by the second and third rollers as the first group paper moves, and simultaneously, moving the first group paper into the paper feed slot by the first roller to shred the second group paper.

In a still further embodiment, a method of shredding a paper shredder includes: disposing a paper on a paper support part including a first paper support part and a second paper support part with a paper feed slot therebetween; and moving the paper into the paper feed slot by at least one roller disposed on the first paper support part and at least one roller disposed on the second paper support part to shred the paper, wherein the number of rollers contacting the paper is reduced as the paper moves into the paper feed slot.

The details of one or more embodiments are set forth in the accompanying drawings and the description below. Other features will be apparent from the description and drawings, and from the claims.

Advantageous Effects

The present disclosure can provide a paper shredder having a new structure and a method of shredding a paper.

The present disclosure can provide a paper shredder that reduces troubles generated in an automatic paper feeding system such as paper jam, paper overfeeding, and paper feeding interruption and a method of shredding a paper.

The present disclosure can provide a paper shredder that further quickly shreds a paper and a method of shredding a paper.

DETAILED DESCRIPTION

Hereinafter, a paper shredder and a method of shredding a paper according to an embodiment will be described in detail with reference to the accompanying drawings.

Figure 1:
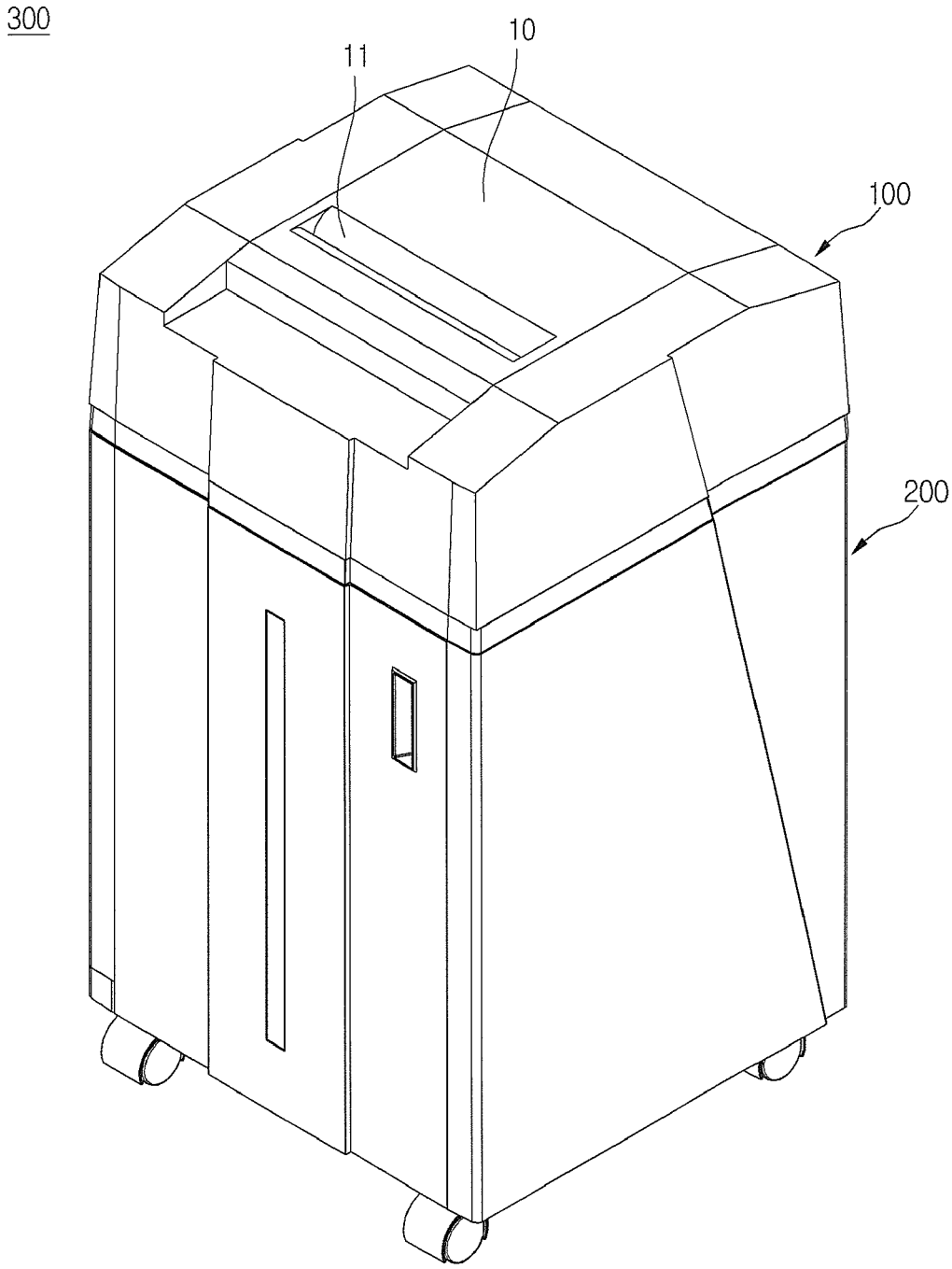
FIG. 1 is a perspective view of a paper shredder according to an embodiment.
Figure 2:
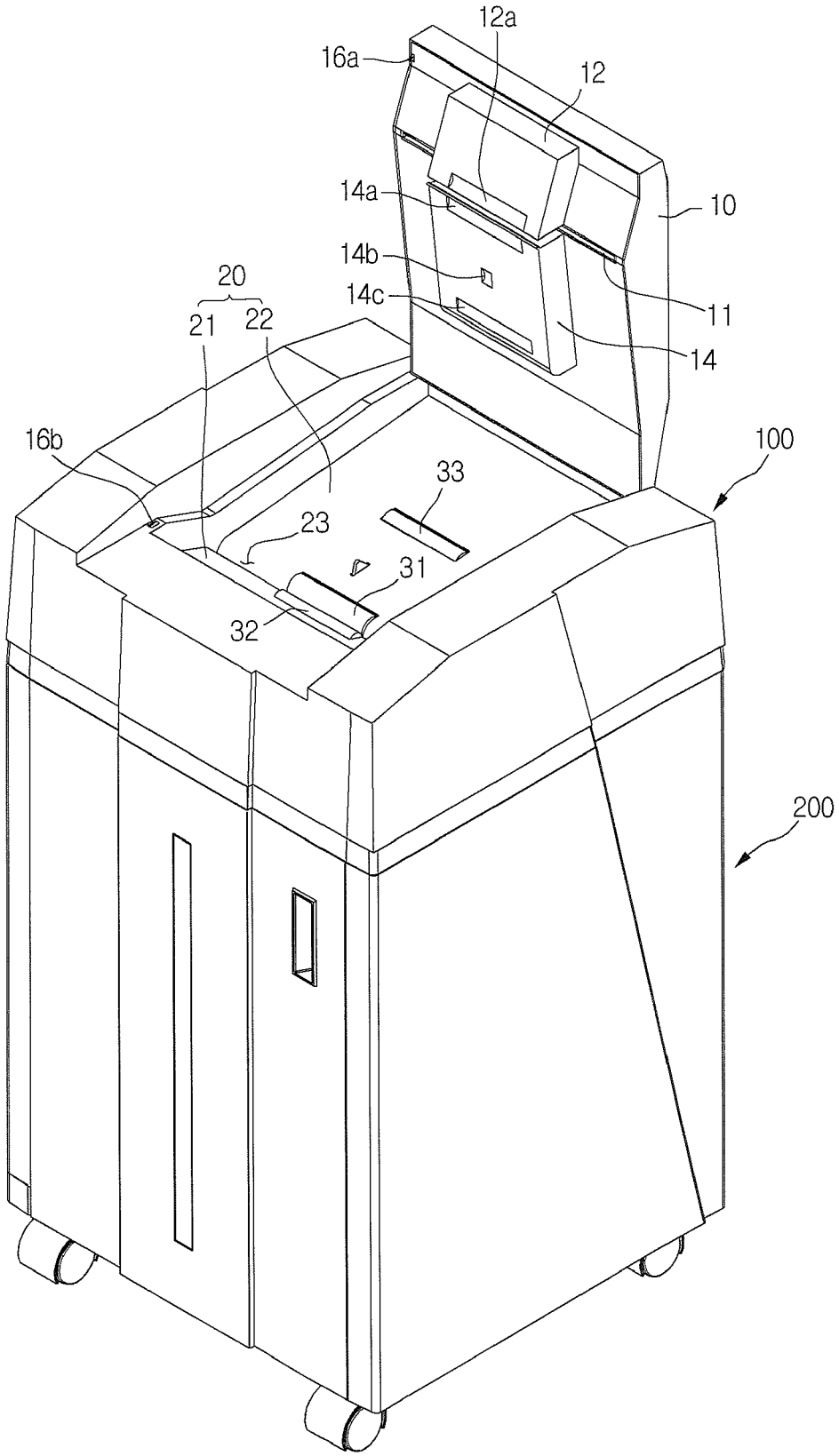
FIG. 2 is a perspective view of a paper shredder with a cover opened according to an embodiment.
Figure 3:
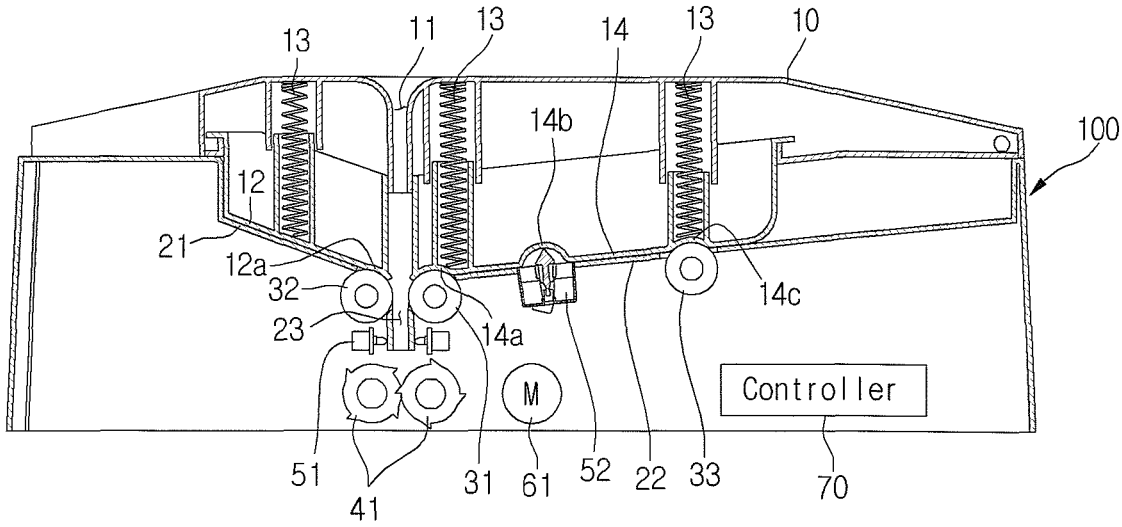
FIG. 3 is a sectional view of a paper shredding part in a paper shredder according to an embodiment.
Figure 4:
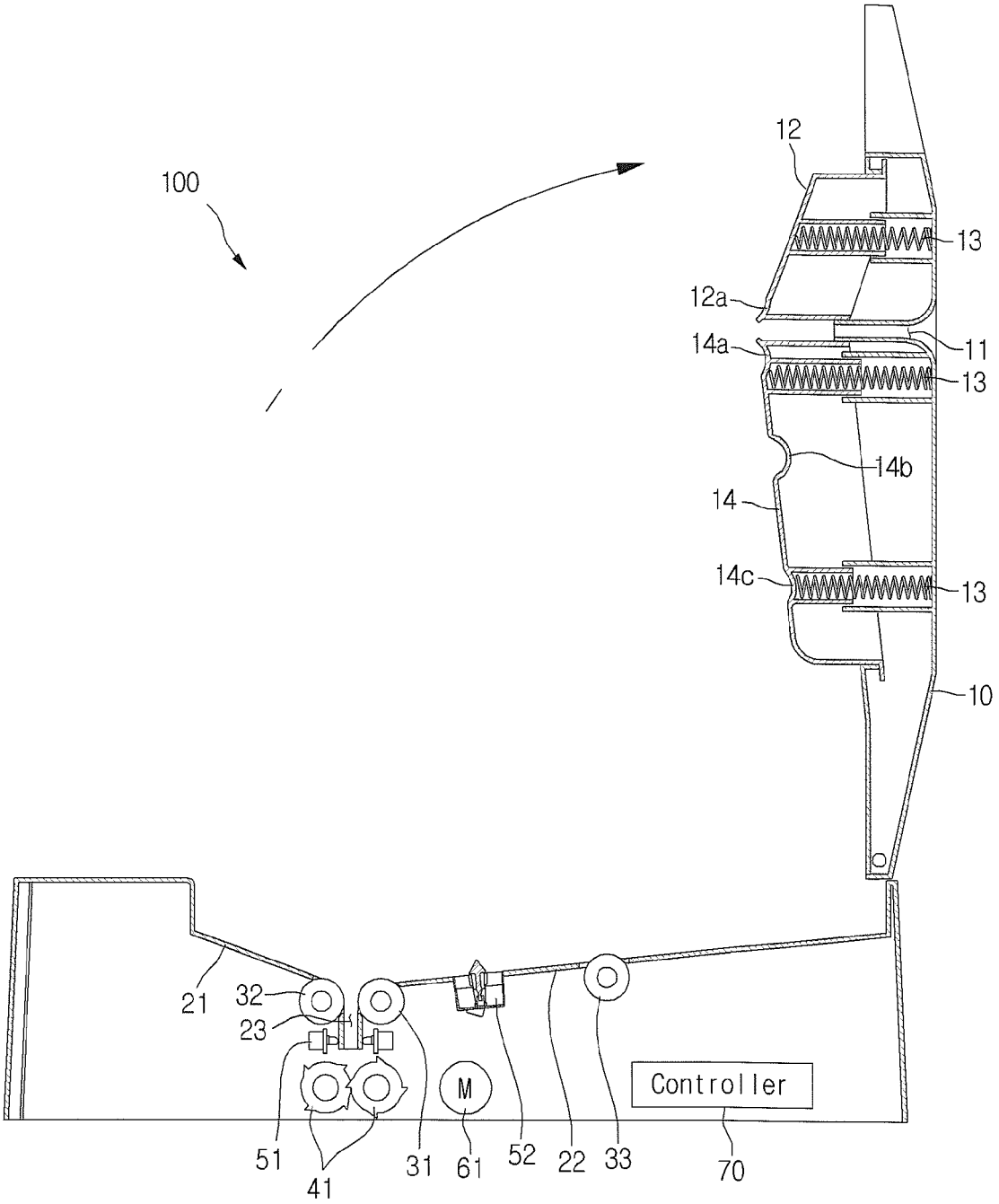
FIG. 4 is a sectional view of a paper shredder with a cover opened according to an embodiment.
Figure 5:
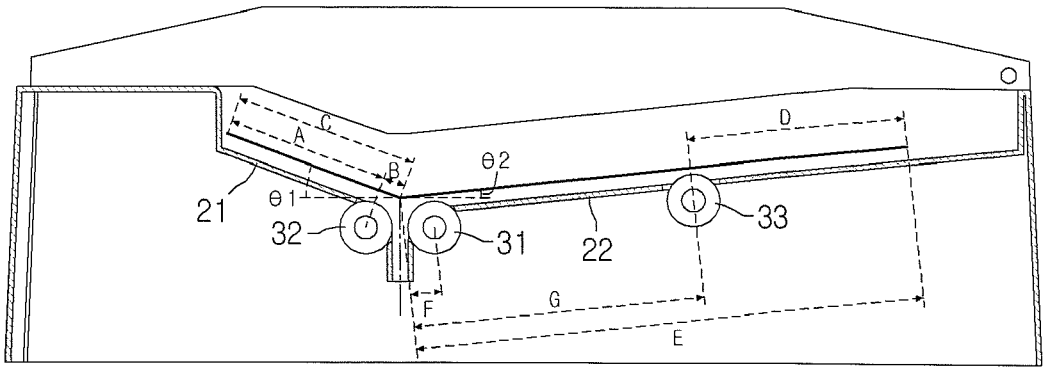
FIG. 5 is a view illustrating a length and angle of a paper support part in a paper shredder according to an embodiment.

FIG. 1 is a perspective view of a paper shredder according to an embodiment, and FIG. 2 is a perspective view of a paper shredder with a cover opened according to an embodiment. FIG. 3 is a sectional view of a paper shredding part in a paper shredder according to an embodiment, and FIG. 4 is a sectional view of a paper shredder with a cover opened according to an embodiment. FIG. 5 is a view illustrating a length and angle of a paper support part in a paper shredder according to an embodiment.

Referring to FIGS. 1 to 5, a paper shredder 300 according to an embodiment includes a paper shredding part 100 and a paper box 200 disposed below the paper shredding part 100 to support the paper shredding part 100. The paper shredding part 100 is a part in which a paper is shredded by feeding the paper, and the paper box 200 is a part in which the paper shredded by the paper shredding part 100 is stored.

Although the paper shredding part 100 and the paper box 200 are coupled to each other in FIGS. 1 and 2, the paper box 200 is not necessary. That is, an operation of the paper shredder 300 according to an embodiment may be executed by only the paper shredding part 100. The paper box 200 stores the paper shredded by the paper shredding part 100 and supports the paper shredding part 100. For example, the paper shredding part 100 may be fixed to any device, and then, a disposable garbage bag may be disposed below the paper shredding part 100.

Also, a motor, a control unit, and an interface may be disposed within the paper box 200 to operate the paper shredding part 100 and the paper box 200 together with each other.

The paper shredding part 100 includes a cover 10 and a paper support part 20. Papers to be shredded may be disposed in a space between the cover 10 and the paper support part 20.

The paper support part 20 includes a first paper support part 21 and a second paper support part 22. The first paper support part 21 and the second paper support part 22 are disposed on both sides of a paper feed slot 23.

A first roller 31, a second roller 32, and a third roller 33 may be disposed on the paper support part 20. That is, at least one roller may be disposed on the first paper support part 21, and at least one roller may be disposed on the second paper support part 22. In the present embodiment, the second roller 32 is disposed on the first paper support part 21, and the first roller 31 and the third roller 33 are disposed on the second paper support part 22.

In the present embodiment, the first paper support part 21 and the second paper support part 22 may be disposed on both sides of the paper feed slot 23, and at least one of the roller disposed on the first paper support part 21 and the rollers disposed on the second paper support part 22 may be disposed asymmetrically with respect to each other. Also, the asymmetric number of rollers may be provided on the first and second paper support parts 21 and 22. As a result, the paper shredder 300 according to an embodiment may further quickly shred the papers. Also, as seen in the FIGURES (e.g., FIGS. 3-7). the first and second paper support parts 21 and 22 can be sloped up from the paper feed slot 23. That is, the first paper support part 21 can include a first proximal portion adjacent to the paper feed slot 23 and a first distal portion at an end of the first paper support part 21 opposite from the first proximal portion, and the second paper support part 22 can include a second proximal portion adjacent to the paper feed slot 23 and a second distal portion at an end of the second paper support part 22 opposite from the second proximal portion. The first and second paper support parts 21 and 22 can be sloped such that a height of the first paper support part 21, measured with respect to a bottom portion of the paper shredder 300, is smallest at the first proximal portion, gradually and continuously increases as the first distal portion is approached from the first proximal portion, and is greatest at the first distal portion, and a height of the second paper support part 22, measured with respect to the bottom portion of the paper shredder 300, is smallest at the second proximal portion, gradually and continuously increases as the second distal portion is approached from the second proximal portion, and is greatest at the second distal portion.

The second roller 32 disposed on the first paper support part 21 may be disposed asymmetrically with the first roller 31 disposed on the second paper support part 22 with respect to the paper feed slot 23. That is, a distance F from a center of the first roller 31 to a center of the paper feed slot 23 may be substantially equal or similar to a distance B from a center of the second roller 32 to the center of the paper feed slot 23. For example, the distance F from the center of the first roller 31 to the center of the paper feed slot 23 may be designed to have a deviation of about 10% or less with respect to the distance B from the center of the second roller 32 to the center of the paper feed slot 23.

Also, the third roller 33 disposed on the second paper support part 22 may be disposed asymmetrically with the second roller 32 disposed on the first paper support part 21 around the paper feed slot 23. That is, a distance G from a center of the third roller 33 to the center of the paper feed slot 23 may be greater than the distance B from the center of the second roller 32 to the center of the paper feed slot 23.

Also, the sum of an effective distance C of the first paper support part 21 and an effective distance E of the second paper support part 21 may have a substantially equal or similar to a length of A4-size paper that is the standard size of paper or a length of a standard letter size paper.

Also, a distance A from the center of the second roller 32 to an end of an effective region of the first paper support part 21 may be equal or similar to a distance D from the center of the third roller 33 to an end of an effective region of the second paper support part 22. For example, the distance A may be designed to have a deviation of about 20% or less with respect to the distance D. In this case, it may be possible to further effectively transfer the papers.

Also, the sum of a distance twice as much as the distance C from the center of the paper feed slot 23 to the end of the effective region of the first paper support part 21, i.e., a distance twice as much as the effective distance C of the paper feed slot 23 and a distance G from the center of the third roller 33 to the center of the paper feed slot 23 may be substantially equal or similar to the length of A4-size paper that is the standard size of paper or the length of the letter size paper, and also have a deviation of about 20% or less with respect to the length of A4-size paper that is the standard size of paper or the length of the letter size paper.

For example, when the distance C from the center of the paper feed slot 23 to the end of the effective region of the first paper support part 21 is designed to have a quarter of the A4-size paper length, the distance G from the center of the third roller 33 to the center of the paper feed slot 23 may be designed to have a deviation of about 20% or less with respect to a half of the A4-size paper length.

Rotation shafts of the first roller 31, the second roller 32, and the third roller 33 are disposed below the first paper support part 21 and the second paper support part 22. Also, portions of the first, second, and third rollers 31, 32, and 33 are exposed upward from the first and second paper support parts 21 and 22.

The first roller 31 and the third roller 33 are rotated in a first direction to move the paper toward the paper feed slot 23. The second roller 32 is rotated in a second direction opposite to the first direction to move the paper toward the paper feed slot 23. For example, the first roller 31 and the third roller 33 may be rotated in a counterclockwise direction, and the second roller 32 may be rotated in a clockwise direction.

As the first roller 31, the second roller 32, and the third roller 33 are rotated, the paper disposed on the first is folded at a portion on disposed on the paper feed slot 23 and fed into the paper feed slot 23.

Surfaces of the first, second, and third rollers folded together with the paper may be formed of a rubber material to increase a friction force of the surfaces folded together with the paper, or pins may be disposed on the surfaces folded together with the paper.

A cutter 41 is disposed below the paper feed slot 23. The cutter 41 crushes the paper fed through the paper feed slot 23.

A paper feed detection sensor 51 may be disposed between the paper feed slot 23 and the cutter 41. The paper feed detection sensor 51 detects whether the paper is fed through the paper feed slot 23. Here, when the paper is not fed into the paper feed slot 23, the cutter 41 is not rotated. For example, the paper feed detection sensor 51 may be realized as an optical sensor including a light emitting part and a light receiving part, which are respectively disposed on both sides of the paper feed slot 23.

A motor 61 is disposed below the paper support part 20. The motor 61 receives a power source to operate the cutter 41, the first roller 31, the second roller 32, and the third roller 33. The motor 61 may be respectively connected to the cutter 41, the first roller 31, the second roller 32, and the third roller 33 through gears or belts to transmit a rotation force generated in the motor 61. Here, the rotation force may be transmitted through various methods.

A paper accumulation detection sensor 52 may be disposed in the second paper support part 22. The paper accumulation detection sensor 52 detects whether the accumulated papers exist on the second paper support part 22. Here, when the accumulated papers do not exist on the second paper support part 22, the cutter 41 and/or the first, second, and third rollers 31, 32, and 33 are not rotated after a predetermined time elapsed.

Figure 12:
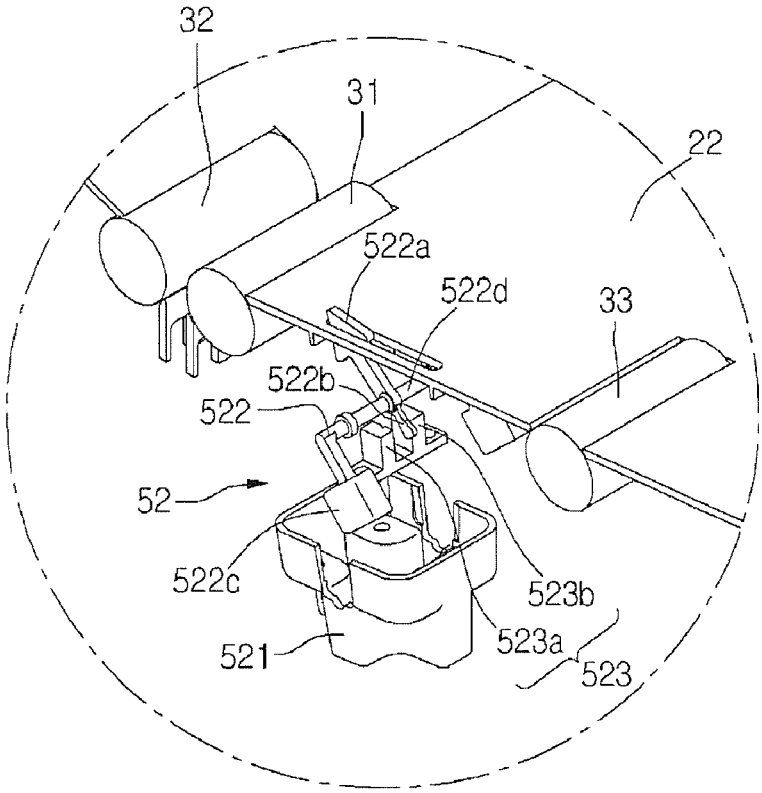
FIGS. 12 and 13 are views of a paper accumulation detection sensor.
Figure 13:
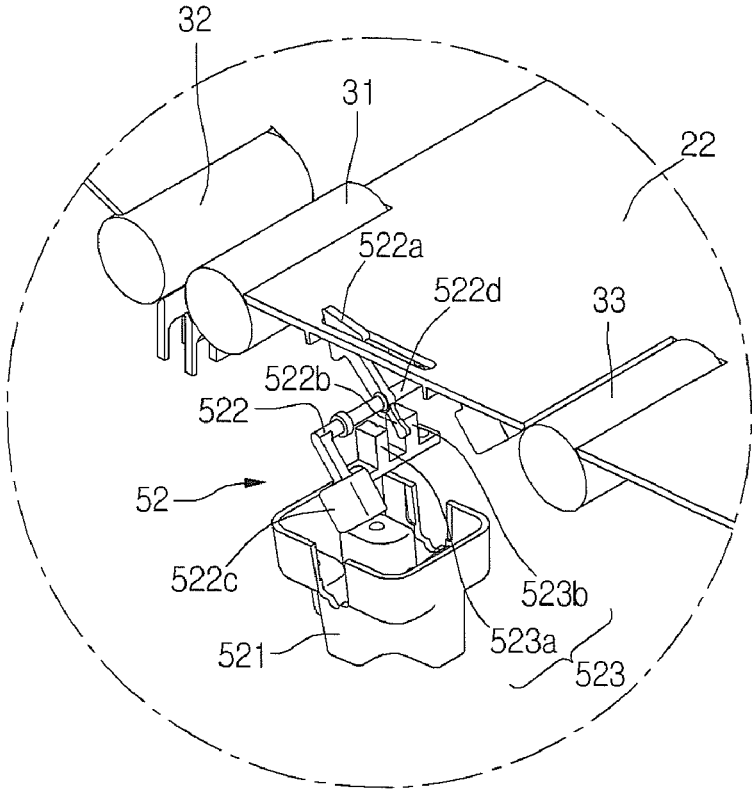

FIGS. 12 and 13 are views of a paper accumulation detection sensor.

Referring to FIGS. 12 and 13, the paper accumulation detection sensor 52 includes a sensor bracket 521, a rotation lever 522 installed on and supported by the sensor bracket 521, and a sensor unit 523. In FIGS. 12 and 13, for convenience of comprehension, the rotation lever 522 and the sensor unit 523 are separated from the sensor bracket 521.

The rotation lever 522 includes a contact part 522*a*, a shield part 522*b*, weights 522*c*, and a rotation shaft 522*d*.

A portion of the contact part 522*a* protrudes upward from the second paper support part 22. Thus, when the paper is disposed on the second paper support part 22, the portion of the contact part 522*a* is rotated around the rotation shaft 522*d* by a force pressed by the paper. The rotation shaft 522*d* is rotatably coupled to the sensor bracket 521.

The shield part 522*b* is coupled to the rotation shaft 522*d*. In the present embodiment, the contact part 522*a* and the shield part 522*b* are disposed in directions opposite to each other with the rotation shaft 522*d* therebetween.

The shield part 522*b* is disposed between a light emitting part 523*a* and a light receiving part 523*b* of the sensor unit 523 to shield incident light from the light emitting part 523*a* toward the light receiving part 523*b*. The sensor unit 523 detects a signal difference between a case in which the shield part 522*b* is disposed between the light emitting part 523*a* and the light receiving part 523*b* and a case in which the shield part 522*b* is not disposed between the light emitting part 523*a* and the light receiving part 523*b* to detect whether the paper is disposed on the second paper support part 22.

The weights 522*c* are coupled to both ends of the rotation shaft 522*d*. The respective weights 522*c* move to a lowest position thereof by gravity when the paper is not disposed on the second paper support part 22. As a result, the shield part 522*b* is disposed between the light emitting part 523*a* and the light receiving part 523*b*. When the paper is disposed on the second paper support part 22, the weights 522*c* are rotated around the rotation shaft 522*d* because the contact part 522*a* is pressed. As a result, the shield part 522*b* is not disposed between the light emitting part 523*a* and the light receiving part 523*b*.

Since the rotation lever 522 is operated by directly contacting the paper and thus the sensor unit 523 detects an optical signal, the paper accumulation detection sensor 52 according to an embodiment determines whether the paper is disposed.

According to another embodiment, the paper accumulation detection sensor 52 may be disposed in the first paper support part 21 and/or the second paper support part 22. According to another embodiment, the paper accumulation detection sensor 52 may be realized as an optical sensor including the light emitting part and the light receiving part, which are respectively disposed above and below the second paper support part 22. In this case, the sensor may perform an abnormal operation due to foreign substances such as paper dusts accumulated between the light emitting part and the light receiving part. Also, in case where one sheet of paper is disposed, the light emitted from the light emitting part may easily transmit the paper to cause a malfunction of the optical sensor.

Also, the paper feed detection sensor 51 may include a rotation lever and a sensor unit, likewise the paper accumulation detection sensor 52.

Signals detected by the paper feed detection sensor 51 and the paper accumulation detection sensor 52 are transmitted to a controller 70. The controller 70 controls an operation of the cutter 41 and/or operations of the first, second, and third rollers 31, 32, and 33 according to the signals transmitted from the paper feed detection sensor 51 and the paper accumulation detection sensor 52.

The cover 10 is disposed above the paper support part 20, and a side of the cover 10 is rotatably coupled to the paper support part 20. That is, as shown in FIGS. 1 and 2, the cover 10 is openably provided.

Referring to FIG. 2, a pressing protrusion 16*a* is disposed on the cover 10, and a micro switch 16*b* is disposed on a side of the paper shredding part 100 corresponding to the pressing protrusion 16*a*. When the cover 10 is closed, the pressing protrusion 16*a* presses the micro switch 16*b*. Thus, the controller 70 may detect a signal representing whether the cover is in an open state through the micro switch 16*b*, and thus the controller 70 may control the operation of the paper shredding part 100. For example, the paper shredding part may operate only when the cover 10 is closed.

The cover 10 includes a first press unit 12 and a second press unit 14. The first press unit 12 is disposed above the first paper support part 21 and elastically supported by a spring 13. The second press unit 14 is disposed above the second paper support part 22 and elastically supported by the spring 13.

The first press unit 12 and the second press unit 14 press the paper disposed on the paper support part 20 to smoothly feed the paper into the paper feed slot 23 due to an adequate friction force generated by the rotation of the first, second, and third rollers 31, 32, and 33.

The first press unit 12 and the second press unit 14 have a first concave receiving groove 12*a* and second concave receiving grooves 14*a*, 14*b*, and 14*c* in portions corresponding to the first, second, and third rollers 31, 32, and 33 and the paper accumulation detection sensor 52. The first receiving groove 12*a* and the second receiving grooves 14*a*, 14*b*, and 14*c* prevent the friction force from being excessively generated between the first, second, and third rollers 31, 32, and 33 and the paper accumulation detection sensor 52 and the paper. Also, the first receiving groove 12*a* and the second receiving grooves 14*a*, 14*b*, and 14*c* allow the paper disposed on the first, second, and third rollers 31, 32, and 33 to have a shape curved along shapes of the first, second, and third rollers 31, 32, and 33, thereby effectively transferring the paper by the first, second, and third rollers 31, 32, and 33.

The second receiving groove 14*b* defined above the paper accumulation detection sensor 52 prevents the paper shredding part 100 from being malfunctioned due to the contact part 522*a* of the paper accumulation detection sensor 52 pressed by the second press unit 14 when the paper is not disposed on the second paper support part 22.

Also, a manual paper feed slot 11 may be further defined in the cover 10. The manual paper feed slot 11 is disposed above the paper feed slot 23 to allow a user to directly feed a small amount of paper.

In the present embodiment, the first paper support part 21 has a first length C extending from the paper feed slot 23, and the second paper support part 22 has a second length E extending from the paper feed slot 23 and greater than the first length C. That is, the first paper support part 21 and the second paper support part 22 have the lengths asymmetrically extending from the paper feed slot 23.

Also, in the present embodiment, the first paper support part 21 has a first inclination θ1 with respect to a horizontal plan, and the second paper support part 22 has a second inclination θ2 less than the first inclination θ1 with respect to the horizontal plan. That is, the first paper support part 21 and the second paper support part 22 have surfaces inclined at angles different from each other. For example, the first paper support part 21 has a height significantly decreasing as being adjacent to the paper feed slot 23 from an end thereof. On the other hand, the second paper support part 22 has a height smoothly decreasing as being adjacent to the paper feed slot 23 from an end thereof. Also, the first inclination θ1 may be less than the second inclination θ2.

That is, in the present embodiment, the paper support part 20 has the angles and/or lengths on both sides thereof with respect to the paper feed slot 23, i.e., has an approximately asymmetrical V-shape or Y-shape.

In general, when a paper is fed into a printer or fax for printing or copy and then is transferred for a next process, the paper should be fed without being wrinkled in shape from one end to the other end. However, since the paper shredder is used for shredding a paper, it does not matter that the paper is wrinkled or folded. Particularly, since a paper to be shredded is in a damaged state such as bending, wrinkle or rip due to exposure to the moisture for a long time, it is not easy to control a position of an end of the paper to shred the paper by feeding the paper into the paper feed slot 23 from the end of the paper.

Thus, the paper shredder 300 according to an embodiment includes the paper support part 20 having an asymmetrical shape to feed the paper in a state where the fed paper is asymmetrically folded.

Figure 6:
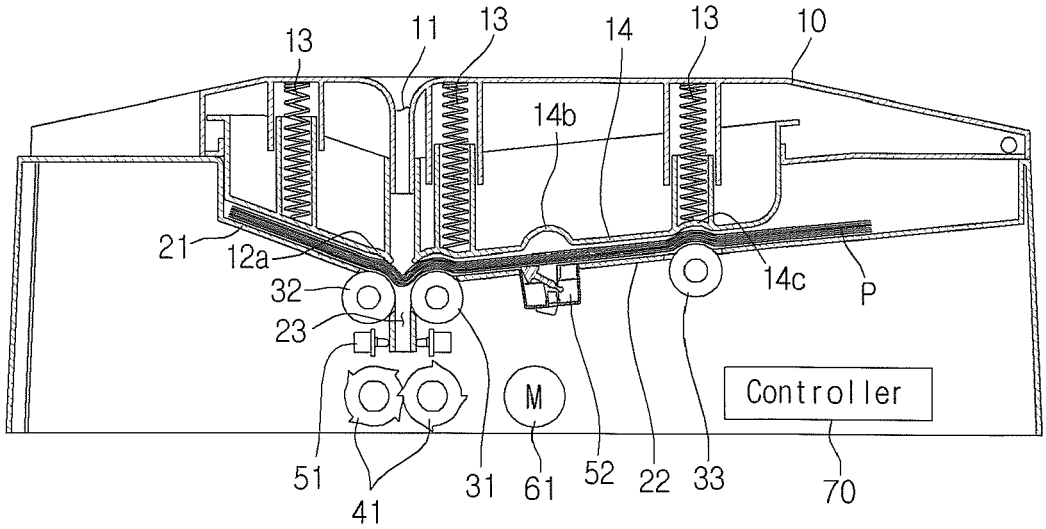
FIGS. 6 and 7 are views illustrating an example of an operation of a paper shredder according to an embodiment.
Figure 7:
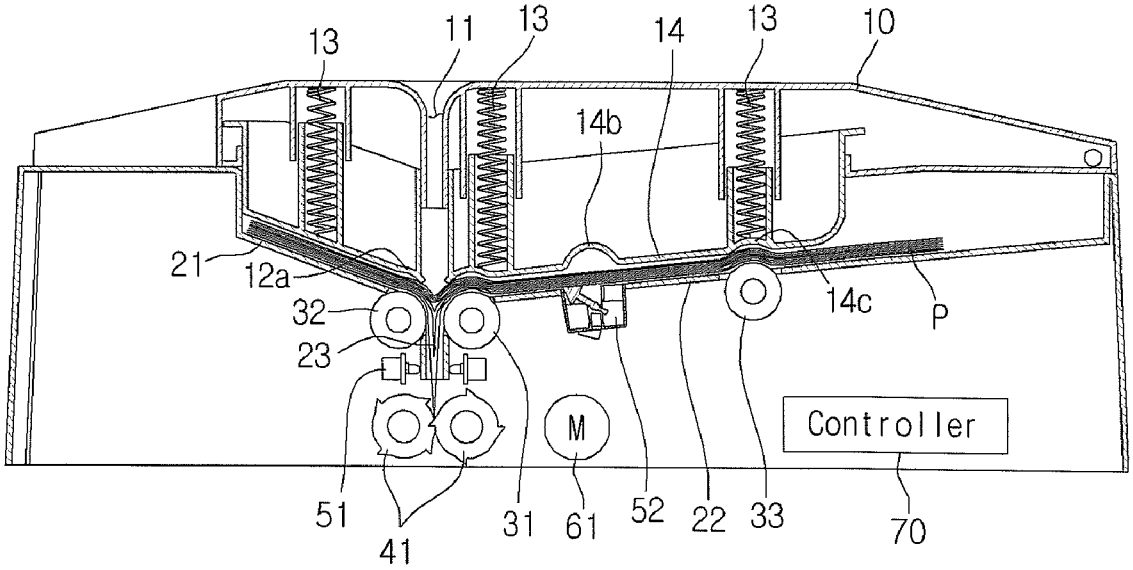

FIGS. 6 and 7 are views illustrating an example of an operation of a paper shredder according to an embodiment.

Referring to FIGS. 6 and 7, in the paper shredder according to an embodiment, the cover 10 is rotated and opened to expose the paper support part 20 as shown in FIG. 4. Then, a large amount of paper is disposed on the paper support part 20.

When the cover 10 is closed, the controller 70 may detect a signal generated when the pressing protrusion 16*a* presses the micro switch 16*b* and a signal generated from the paper accumulation detection sensor 52 to operate the paper shredder 300.

When the first, second, and third rollers 31, 32, and 33 are rotated, a first group paper adjacent to the first, second, and third rollers 31, 32, and 33, i.e., a lower first group paper of the large amount of paper P is fed into the paper feed slot 23 by the rotation force of the first, second, third rollers 31, 32, and 33. The first group paper may be one sheet of paper or two to four sheets of paper disposed at undermost position of the large amount of paper P. That is, the number of papers to be simultaneously transferred may be changed according to characteristics of the first, second, and third rollers 31, 32, and 33 or conditions of the papers.

The first and third rollers 31 and 33 are rotated in a direction different from that of the second roller 32. Also, a portion at which the paper feed slot 23 is disposed is lower than the first paper support part 21 and the second paper support part 22. Thus, the papers P are introduced into the paper feed slot 23 while a portion corresponding to the portion at which the paper feed slot 23 is disposed is folded, and then the papers P are shredded.

Here, the first group paper fed firstly into the paper feed slot 23 is asymmetrically folded. Firstly, the first group paper moves by forces applied from the first, second, and third rollers 31, 32, and 33. Then, as the first group paper is inserted into the paper feed slot 23 while being folded, the first group paper is introduced into the paper feed slot 23 by the force applied from the first roller 31. When a portion of the first group paper is introduced into the cutter 41, the paper may be further easily introduced into the paper feed slot 23 by a force in which the cutter 41 pulls the paper thereto except the force applied from the first, second, and third rollers 31, 32, and 33. For example, the number of the first group paper may be one to four sheets. Also, the number of papers to be simultaneously moved may be changed according to the friction force between the papers or the conditions of the papers.

Also, firstly, the first group paper may move by the forces applied from the first, second, and third rollers 31, 32, and 33, and then, as the first group paper is inserted into the paper feed slot 23 while being folded, the first group paper may be introduced by the force applied from the first and second roller 31 and 32. Lastly, the first group paper may be introduced into the paper feed slot 23 by the force applied from the first roller 31.

That is, in the present embodiment, the paper moves into the paper feed slot 23 by the forces applied from the plurality of rollers. As the paper moves, the number of the rollers applying the forces decreases. Then, the paper may be introduced into the paper feed slot 23 by the force applied from one final roller. This is done because the plurality of rollers and the paper support part 20 are asymmetrically disposed in position with respect to the paper feed slot 23.

Since the second and third rollers 32 and 33 are continuously rotated, the second and third rollers 32 and 33 may apply the forces to a secondarily fed second group paper while the first roller 31 applies the force to the first group paper. That is, the second and third rollers 32 and 33 push the secondarily fed second group paper disposed on the primarily fed first group paper while the first roller 31 pushes the primarily fed first group paper.

Since the secondarily fed second group paper receives a force moving together with the first group paper by a friction force therebetween along the primarily fed first group paper, the secondarily fed second group paper may smoothly move into the paper feed slot 23 even though the second group paper receives the force directly applied by only the third roller 33 and/or the second roller 32.

Thus, since the secondarily fed second group paper is fed into the paper feed slot 23 at the same time while the primarily fed first group paper is fed into the paper feed slot 23, a large amount of paper may be quickly shredded. Like the first group paper, the second group paper may be one sheet of paper or two to four sheets.

Figure 8:
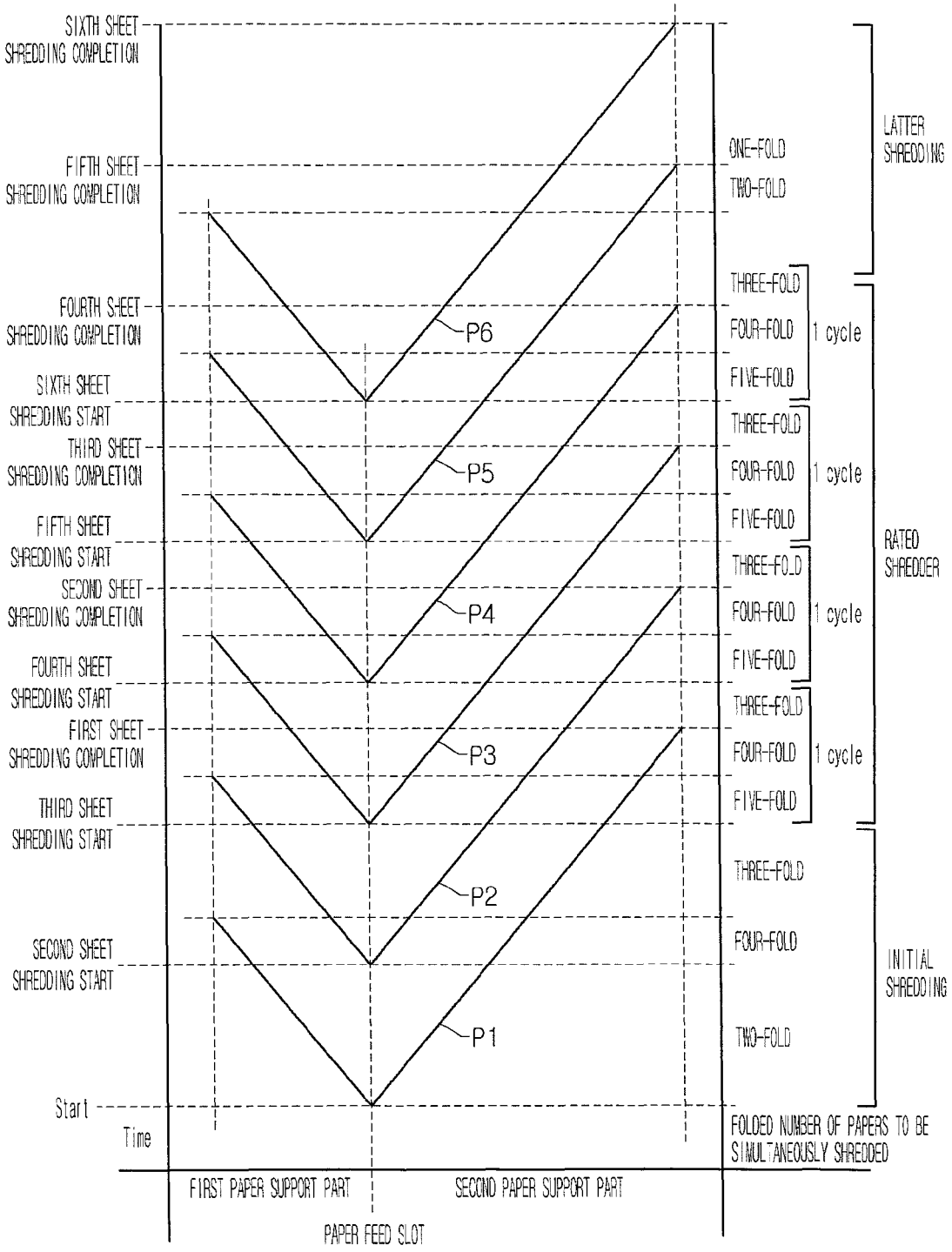
FIGS. 8 and 9 are views illustrating a method of shredding a paper in a paper shredder according to an embodiment.
Figure 9:
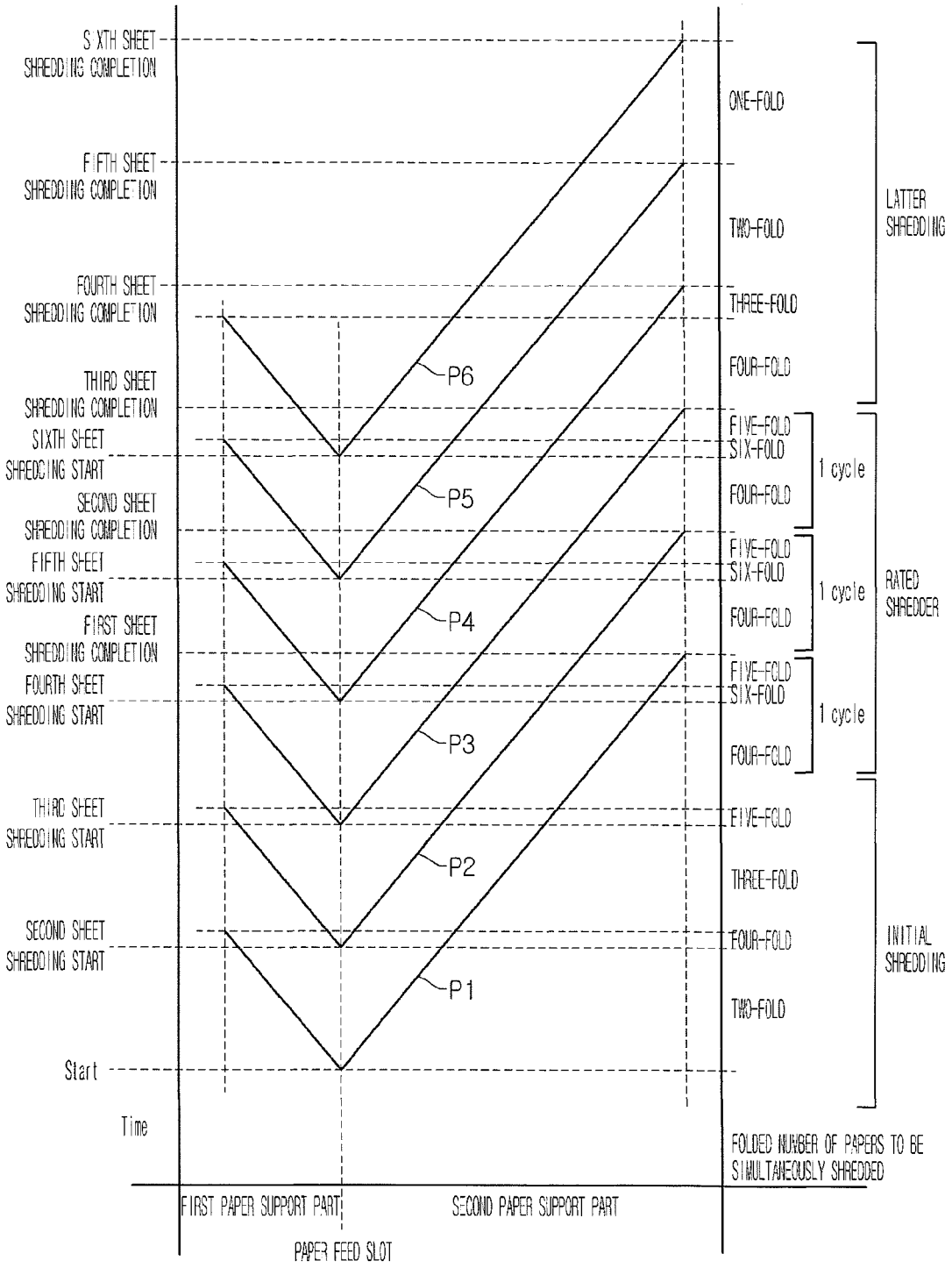
Figure 10:
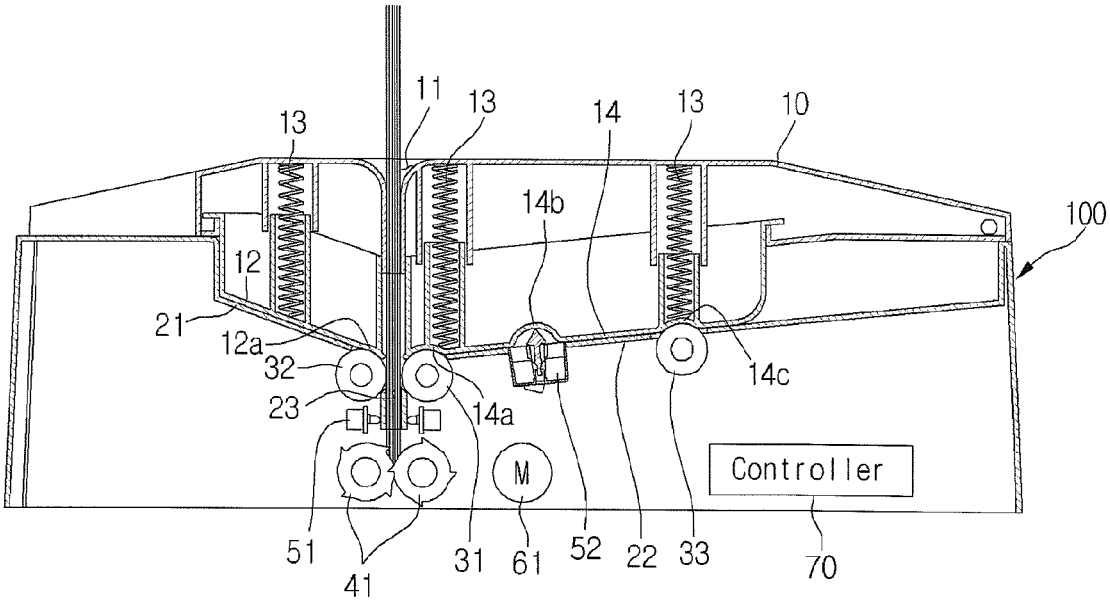

FIGS. 8 and 10 are views illustrating a method of shredding a paper in a paper shredder according to an embodiment. For convenience of description in FIGS. 8 to 10, it will be assumed that several sheets of paper do not move by the first, second, and third rollers 31, 32, and 33 at the same time, but only one sheet of paper moves by the first, second, and third rollers 31, 32, and 33.

In the present embodiment, the first paper support part 21 may have a length C equal to about ⅕ to ⅓ of the length of the of A4-size paper that is the standard size of paper. For example, the A4-size paper may have a length of about 297 mm, and the first paper support part 21 may have the length C of about 59.4 mm to about 99 mm. However, the length C of the first paper support part 21 is not limited to the above-described range. For example, the length C of the first paper support part 21 may have a length less than that of about 59.4 mm or greater than that of about 99 mm.

In the present embodiment, the first paper support part 21 may have a length C equal to about ⅕ to ⅓ of the length of the letter size paper that is the standard size of paper. For example, the length of the letter size paper may have a length of about 279.4 mm, and the first paper support part 21 may have the length C of about 55.9 mm to about 93.2 mm. However, the length C of the first paper support part 21 is not limited to the above-described range. For example, the length C of the first paper support part 21 may have a length less than that of about 55.9 mm or greater than that of about 93.2 mm.

FIG. 8 is a view illustrating a process of shredding a paper while being introduced into the paper feed slot 23 when the first paper support part 21 has a length C of about 99 mm.

In the paper shredder 300 according to an embodiment, when a plurality of papers is disposed on the paper support part 20, the folded number of papers to be simultaneously shredded is changed according to initial shredding, a rated shredder, and latter shredding.

For example, a first sheet of paper P1 is folded in the initial shredding, and simultaneously, a two-fold paper is shredded. Thereafter, four-fold and three-fold papers are sequentially shredded. Then, in the rated shredder, five-fold, four-fold, and three-fold papers are sequentially shredded with a constant cycle. In the latter shredding, two-fold and one-fold papers are sequentially shredded.

When the paper shredder 300 is operated in a state where a plurality of papers is disposed on the paper support part 20, the first sheet of paper P1 disposed on the first paper support part 21 and the second paper support part 22 is asymmetrically folded in a V shape by a force applied from the first, second, and third rollers 31, 32, and 33. Then, the folded paper is introduced into the paper feed slot 23, and the shredding process starts. Here, the first sheet of paper P1 is shredded into the two-fold paper.

As the first sheet of paper P1 moves from the paper support part 20 toward the paper feed slot 23, the second and third rollers 32 and 33 are folded together with a second sheet of paper P2. The second sheet of paper P2 is introduced into the paper feed slot 23 by the force applied from the second and third rollers 32 and 33 and then shredded. Here, the first sheet of paper P1 and the second sheet of paper P2 disposed on the first paper support part 21 and the first sheet of paper P1 and the second sheet of paper P2 disposed on the second paper support part 22 are shredded at the same time, and thus, the four-fold paper is shredded.

As the first sheet of paper P1 disposed on the first paper support part 21 is completely shredded, only the second sheet of paper P2 on the first paper support part 21 is introduced into the paper feed slot 23 and then shredded. As the first sheet of paper P1 and the second sheet of paper P2 on the second paper support part 22 are introduced into the paper feed slot 23 and shredded, the three-fold paper is shredded.

In the same manner, as the second sheet of paper P2 moves from the paper support part 20 toward the paper feed slot 23, the second and third rollers 32 and 33 are folded together with a third sheet of paper P3. The third sheet of paper P3 is introduced into the paper feed slot 23 by the force applied from the second and third rollers 32 and 33 and then shredded. Here, the second sheet of paper P2 and the third sheet of paper P3 disposed on the first paper support part 21 and the first sheet of paper P1, the second sheet of paper P2, and the third sheet of paper P3 disposed on the second paper support part 22 are shredded at the same time, and thus, the four-fold paper is shredded.

As described above, the first, second, and third rollers 31, 32, and 33 contact sequentially the papers to allow the papers to be introduced into the paper feed slot 23. The one-fold to five-fold papers are shredded by the cutter 41 according to the folded degree of the papers. Although it is assumed that only one sheet of paper moves when the paper contacts the first, second, and third rollers 31, 32, and 33 in the present embodiment, the present disclosure is not limited thereto. As necessary, since two to four sheets of paper may move at the same time, the folded number of papers to be simultaneously shredded by the cutter 41 may be changed.

FIG. 9 is a view illustrating a process of shredding a paper while being introduced into the paper feed slot 23 when the first paper support part 21 has a length C of about 74.3 mm, and FIG. 10 is a view illustrating a process of shredding a paper while being introduced into the paper feed slot 23 when the first paper support part 21 has a length C of about 5934 mm.

Referring to FIGS. 9 and 10, the more a length of the first paper support part 21 is reduced, the more the papers are quickly introduced into the paper feed slot 23 and the folded number of the papers to be simultaneously shredded increases.

Figure 11:
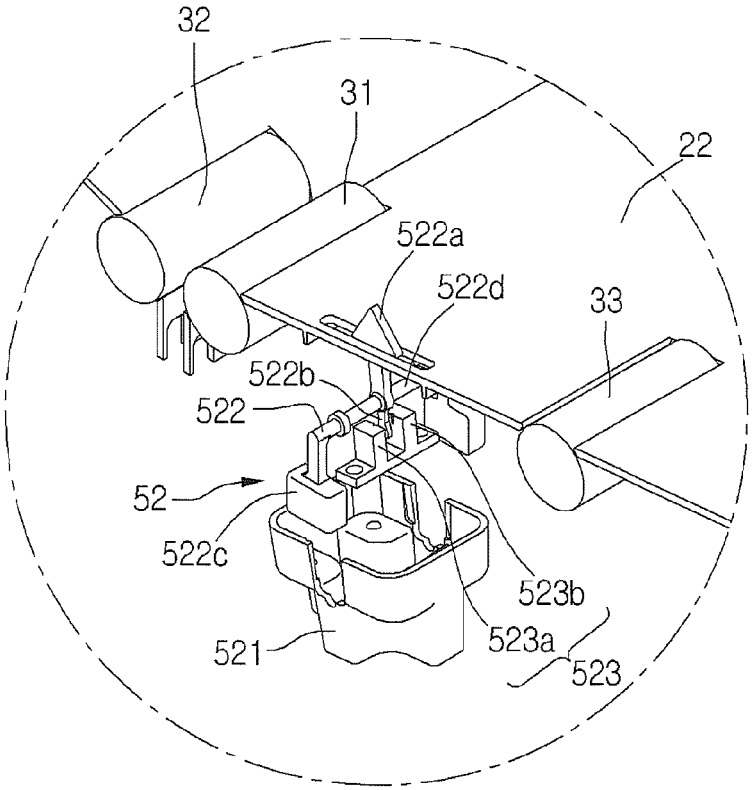
FIG. 11 is a view illustrating a process of manually shredding a paper in a paper shredder according to an embodiment.

FIG. 11 is a view illustrating a process of manually shredding a paper in a paper shredder according to an embodiment.

The cover 10 includes the manual paper feed slot 11 passing through the cover 10 and disposed above the paper feed slot 23. The manual paper feed slot 11 is disposed between the first press unit 12 and the second press unit 14.

Thus, when a paper is fed through the manual paper feed slot 11, the paper passes through the paper feed slot 23 and is shredded by the cutter 41. Here, the paper feed detection sensor detects the paper. As a result, the controller 70 controls an operation of the cutter 41.

According to the embodiment, a method of shredding a paper shredder comprises shredding a first group paper by a cutter disposed below a paper feed slot while the first group paper moves into the paper feed slot by a second roller disposed on a first paper support part and first and third rollers disposed on a second paper support part with the paper feed slot therebetween; and moving a second group paper disposed on the first group paper into the paper feed slot by the second and third rollers as the first group paper moves, and simultaneously, moving the first group paper into the paper feed slot by the first roller to shred the second group paper.

The second group paper moves into the paper feed slot by any one of the second roller and the third roller and moves into the paper feed slot by all of the second roller and the third roller.

According to the embodiment, a method of shredding a paper shredder comprises disposing a paper on a paper support part comprising a first paper support part and a second paper support part with a paper feed slot therebetween; and moving the paper into the paper feed slot by at least one roller disposed on the first paper support part and at least one roller disposed on the second paper support part to shred the paper, the number of rollers contacting the paper is reduced as the paper moves into the paper feed slot.

The number of rollers disposed on the first paper support part and the number of rollers disposed on the second paper support part are different from each other.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

Embodiments may be applicable to the paper shredder and the method of shredding the paper.

What is claimed is:

1. A paper shredder, comprising a paper support part comprising a first paper support part having a first length, a second paper support part having a second length greater than the first length, and a paper feed slot between the first paper support part and the second paper support part;

a first roller in which a portion thereof is exposed upward from the second paper support part through an opening defined in the second paper support part;

a second roller in which a portion thereof is exposed upward from the first paper support part through an opening defined in the first paper support part;

a cutter disposed below the paper feed slot to shred an introduced paper; and a motor operating the first roller, the second roller, and the cutter, wherein the first paper support part comprises a first proximal portion adjacent to the paper feed slot and a first distal portion at an end of the first paper support part opposite from the proximal portion.

wherein the second paper support part comprises a second proximal portion adjacent to the paper feed slot and a second distal portion at an end of the second paper support part opposite from the second proximal portion, wherein a height of the first paper support part, measured with respect to a bottom portion of the paper shredder, is smallest at the first proximal portion, gradually and continuously increases as the first distal portion is approached from the first proximal portion, and is greatest at the first distal portion, wherein a height of the second paper support part, measured with respect to a bottom portion of the paper shredder, is smallest at the second proximal portion, gradually and continuously increases as the second distal portion is approached from the second proximal portion, and is greatest at the second distal portion.

2. The paper shredder according to claim 1, further comprising a third roller in which a portion thereof is exposed upward from the second paper support part through the opening defined in the second paper support part.

3. The paper shredder according to claim 1, wherein the first roller and the second roller are disposed at the same position from the paper feed slot.

4. The paper shredder according to claim 2, wherein the first roller and the second roller are each disposed closer to the paper feed slot than is the third roller.

5. The paper shredder according to claim 1, wherein a paper accumulation detection sensor determining whether papers are accumulated is disposed on the paper support part.

6. The paper shredder according to claim 5, wherein the paper accumulation detection sensor comprises a rotation lever in which a portion thereof passes through the paper support part to expose the portion on the paper support part and is rotated as papers are accumulated and a sensor unit detecting whether the rotation lever is rotated to detect whether the papers are accumulated.

7. The paper shredder according to claim 1, further comprising a cover disposed on the paper support part.

8. The paper shredder according to claim 7, further comprising a first press unit and a second press unit coupled to the cover and elastically supported by the cover, the first press unit disposed on the first paper support part and the second press unit disposed on the second paper support part.

9. The paper shredder according to claim 8, further comprising a manual paper feed slot passing through the cover, the manual paper feed slot being disposed between the first press unit and the second press unit.

10. The paper shredder according to claim 8, further comprising receiving grooves defined in the first press unit and the second press unit.

* * * * *